US005354197A

United States Patent [19]

Barone

[11] Patent Number: 5,354,197

[45] Date of Patent: Oct. 11, 1994

[54] COMBINATION IGNITION FUSE AND CANDLES

[75] Inventor: Joseph I. Barone, 555 Cox Rd., San Marcos, Calif. 92609

[73] Assignee: Joseph I. Barone, Long Beach, Calif.

[21] Appl. No.: 78,635

[22] Filed: Jun. 21, 1993

[51] Int. Cl.[5] ..... F23D 3/16

[52] U.S. Cl. ..... 431/287; 431/289; 431/295

[58] Field of Search ..... 431/288, 290, 291, 289, 431/295, 287, 325; 362/161; 102/310, 320, 360, 361; 44/519

[56] References Cited

U.S. PATENT DOCUMENTS 1,873,201 8/1932 Hitt .
2,544,946 3/1951 Allen ..... 102/361

FOREIGN PATENT DOCUMENTS 922635 6/1947 France ..... 431/295
0046421 3/1984 Japan ..... 431/295

OTHER PUBLICATIONS

Lacroix Eugene, #226, Italy, 1870, p. 229.

*Primary Examiner*—Carl D. Price
*Attorney, Agent, or Firm*—Francis X. LoJacono

[57] ABSTRACT

An igniting means for lighting a group of birthday-type candles, wherein the candles are slidably mounted on a fuse line by means of a substantially flat outwardly extended wick member in which an aperture is formed to threadably receive the fuse line and wherein the fuse line is provided with end members to prevent the candles from sliding off of the fuse line.

12 Claims, 1 Drawing Sheet

COMBINATION IGNITION FUSE AND CANDLES

BACKGROUND OF THE INVENTION

1. Field of the Invention

The invention relates to a device for lighting a group of selectively positioned candles and more particularly to a means for lighting a group of birthday type candles that are threadably mounted on an elongated igniting fuse line or string.

2. Description of the Prior Art

Birthday candles are well known and have been for many years used as a means to light up birthday cakes. The number of candles that are used on a cake vary, of course, depending upon the age of the person whose birthday it might be. A birthday candle is generally formed having an elongated wax body 60 mm long with a diameter of approximately 5 mm and is provided with an internally positioned wick that extends outwardly from the top of the wax body.

These candles, when placed on the surface of the cake, are often arranged to form various decorative design configurations by placing them in straight or curved rows and circles. They can also be arranged to form, for example, heart shapes, stars or positioned to define letters, and so on.

However, when a large group of candles are positioned on a cake they often present several problems when they are to be lit with a match. Usually one does not know which candle to light first so that he or she does not get burned in the process of lighting the remaining candles. Birthday type candles are provided with an extended wick formed from a cotton material which is very soft and sometimes bent to the side of the candle. This too creates a problem in lighting the wick. After several candles are lit it becomes increasingly harder to reach the remaining unlighted candles without getting burned. Further, when trying to light a large group of candles the first few lighted candles have already started to melt which causes the wax to drop on the icing of the cake. Often the flames of the first lighted candles become rather large.

Accordingly, there is a need to provide a simple and safe device and/or method of lighting a group of closely mounted candles that are commonly found with respect to birthday cakes.

SUMMARY AND OBJECTS OF THE INVENTION

The present invention defines a method and device for safely lighting a plurality of candles and more particularly birthday candles used in conjunction with birthday cakes and the like. Each candle according to the present invention is made with a similar body as heretofore described with the exception that the extended wick member is heavily waxed so that it can be provided with an upright extended wick formed having a flat shape with a hole positioned therein. The hole or aperature is adapted to receive a string-like fuse that has a diameter smaller than the diameter of the hole provided in the wick of the candle. A multiplicity of candles are threaded on the fuse line, and stop members are arranged adjacent the opposite ends of the fuse line so that the candles will not slide free from the fuse line.

The fuse is made from any suitable material such as cotton or synthetic material or a combination of both that will allow the fuse to evenly burn from end to end or if lighted at any point along the fuse line will burn at the same rate in two directions, thereby lighting each candle wick as the flame progresses along the fuse to the opposite ends thereof.

Accordingly, it is an important object of the present invention to provide a simple and safe device and method of lighting a group of closely mounted birthday candles commonly used with birthday cakes and the like. These candles, when placed on the surface of the cake, can be readily arranged to form various decorative design configurations or positioned so as to define letters, etc.

Another object of the invention is to provide a simple and safe means for lighting a group of birthday candles that are slidably mounted to an elongated string-like fuse in such a manner that the candles can be selectively positioned on the cake to define a particular design arrangement, whereby all of the candles can be progressively lit by a single match at any point along the fuse line.

Still another object of the present invention is to provide an igniting fuse that comprises thread-like string material that is strung or threaded through a hole disposed in the wick member of each candle.

A further object of the invention is to provide an igniting fuse that can be formed from many types of thread-like materials such as 100% cotton, synthetic-cotton blend, nylon, polyester, rayon or any suitable combination thereof, all of which would be coated or impregnated with an appropriate thin layer of wax, whereby the waxed fuse line will burn at a rate that alloys each juxtaposed candle to ignite in a timed sequence without affecting the wax body of each candle during the lighting process. This then would allow one to light the fuse at any point along its length so that the flame will progressively ignite each candle as the flame travels lengthwise along the fuse line.

Preferably one would light the fuse line at the center point so that the line burns in both directions toward each opposite end of the fuse line.

A still further object of the present invention is to provide a novel way in which to light a group of candles using a fuse line that can be lit at any point along its length whereby the flame will progressively ignite each candle as the flame travels lengthwise along the fuse line and also allow the fuse line to be lit at the center point along the line so that the line burns in both directions toward each end of the fuse line.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

DESCRIPTION OF THE DRAWINGS

With the above and related objects in view, the invention consists in the details of construction and combination of parts, as will be more fully understood from the following description, when read in conjunction with the accompanying drawings and numbered parts which are for illustrative purposes only.

DETAILED DESCRIPTION OF THE PREFERRED EMBODIMENT

Figure 1:
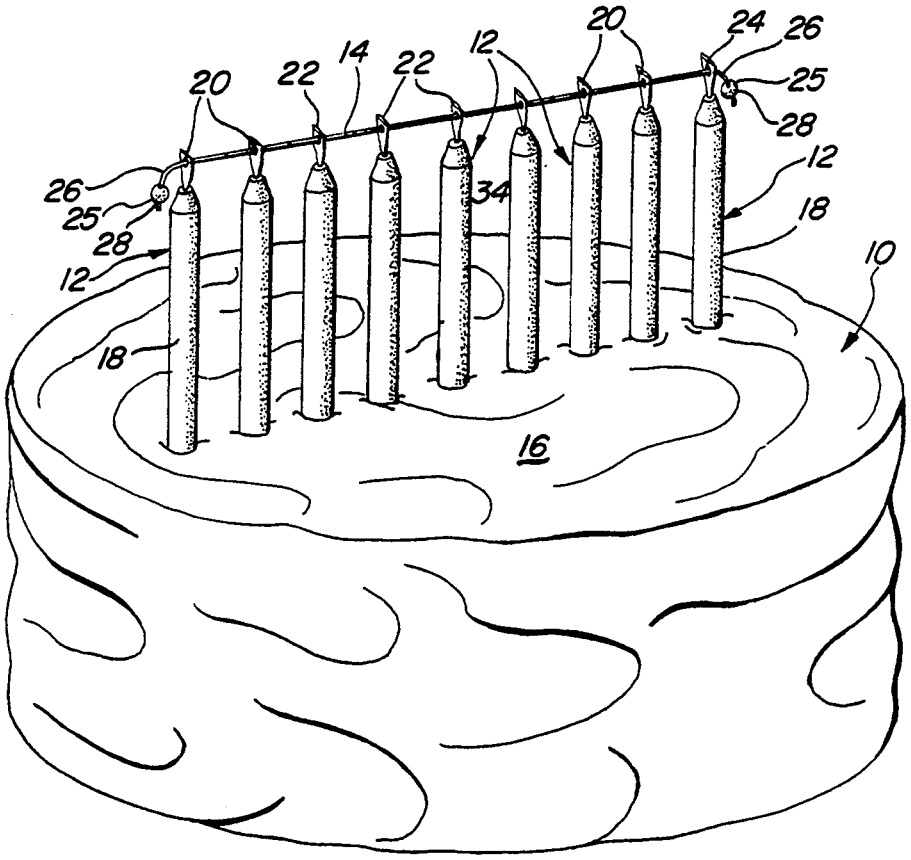
FIG. 1 is a pictorial view of a birthday cake having a multiplicity of birthday candles arranged thereon in accordance with the present invention.

Referring more particularly to FIG. 1, there is shown a pictorial view of a cake, generally indicated at 10, on which is mounted a multiplicity of birthday candles 12. There are ten candles 12 which are illustrated as being arranged in a straight row and interconnected or threaded by a fuse line 14. It is important to note, nevertheless, that any number of candles may be used whereby various arrangements of the candles can be employed to define almost any desired configuration. That is, candles 12 can be arranged on surface 16 of the cake so as to provide an overall heart-shape design, a circular or triangular arrangement or even letters of the alphabet. Many other arrangements and designs are contemplated when two or more strings of candles are used in conjunction with each other. However, for simplicity a single straight-line arrangement is shown in FIG. 1.

Figure 2:
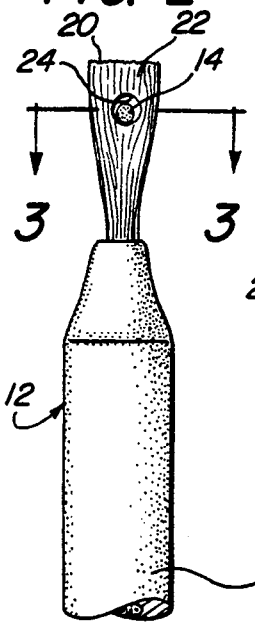
FIG. 2 is an enlarged elevational view taken along line 2—2 of FIG. 1 of the upper portion of a candle showing the fuse line passing through a hole formed in the flattened wick member of the candle.
Figure 3:
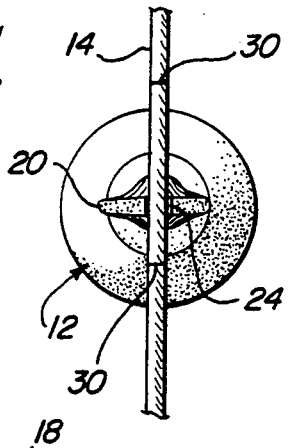
FIG. 3 is an enlarged cross-sectional view taken substantially along line 3—3 of FIG. 2.

The candles can be of any common variety having a suitable wax body member 18 of between 55 to 65 mm long and a body diameter of between 4 mm and 6 mm. A typical elongated wick 20 is encapsulated within the length of wax body member 18 and includes an outwardly extended wick portion 22. This extended wick portion is covered or impregnated with wax so that it will not only burn when lit but allow the wick to become firm. Wick 20 has a substantially flat cross-sectional configuration with a suitable length, defining a thick, flat and somewhat stiff member, as indicated in FIGS. 1, 2 and 3. This arrangement provides the means for forming a single hole or aperture 24 within wick 20, whereby fuse line 14 can be strung through each of the wick members of the candles, as illustrated in the drawings. It should be noted that apertures 24 should have a diameter approximately two to five times greater than that of the diameter of fuse line 14. Hole 24 should be large enough to allow the flame to pass through and ignite the wick without being snuffed out. The flattening of the wick also enlarges the surface area on both sides of the wick so that it causes the wick to more readily catch fire as the flame from the fuse line passes through the aperture.

Figure 5:
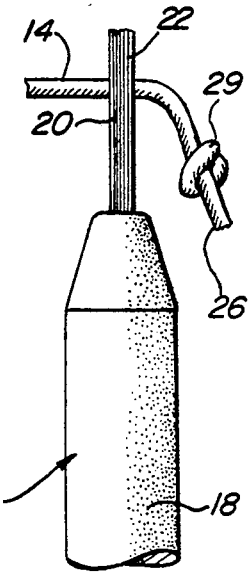
FIG. 5 is an elevation view of the upper portion of a candle having a wick supporting a fuse which has a stop at the end.

In order to prevent the candles from sliding off the fuse line 14 a suitable stop means 25 is formed on each opposite free end 26 of fuse line 14. Stop means 25 is shown herein as a wax bead 28, but may also be formed by a suitable knot 29 at each end 26 of fuse line 14 (FIG. 5).

It should be further noted that fuse line 14 can be provided with several equally spaced candle position markers 30 that are arranged to indicate the most suitable position between each adjacent candle. This is readily seen in FIG. 3. The candles can either be positioned between markers 30 or right on or near each marker so that the spacing between the candles can be relatively equal as the candles are arranged on the cake surface 16.

Igniting fuse 14 can be formed from many types of thread-like materials such as 100% cotton, synthetic-cotton blend, nylon, polyester or rayon or any suitable combination thereof. It is also contemplated that the material of the fuse line could be coated on its surface or impregnated with an appropriate layer of wax, whereby the waxed fuse line will burn at a rate that allows each juxtaposed candle to ignite in a timed sequence without the flame affecting the wax body of each candle during the igniting of the wick. This then would allow one to light the fuse at any point along its length, such as at the point indicated at 32 in FIG. 1, so that the flame will progressively ignite each candle as the flame travels lengthwise along the fuse line in both directions, as indicated by arrows 34 and 36.

Figure 4:
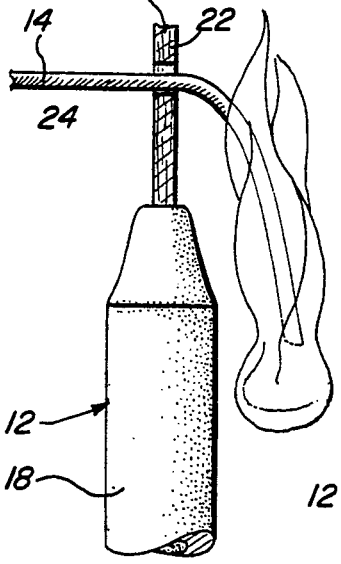
FIG. 4 is an elevation view of the upper portion of a candle showing the wick in cross section and having one end of the fuse line burning.

In FIG. 4 fuse line 14 shows the position of flame 38 after it has just lit the adjacent candle to its right (not shown). The flame rises along the fuse and will ignite wick 22 and then continue burning through hole 24 to the next adjacent candle to its left side (not shown).

It may thus be seen that the objects of the present invention set forth herein, as well as those made apparent from the foregoing description, are efficiently attained. While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

I claim:

1. In combination, a multiplicity of candles threaded on an elongated fuse line for progressively lighting the candles, wherein the improvement comprises:

a multiplicity of candles, each of said candles having a wax body member and an elongated wick positioned within said wax body member, wherein an upper portion of said wick extends outwardly and upwardly from said wax body member, said wick being formed having an aperture of a predetermined diameter disposed therein; and wherein said wick is formed with a substantially flat cross-sectional configuration, whereby enlarged oppositely disposed surfaces are defined in which said aperture is positioned therethrough;

said elongated fuse line threaded through said aperture to allow said fuse line to burn through each said aperture of each wick to progressively ignite each wick at the flat portion in a timed sequence without the flame affecting the wax body of each candle during the igniting of said wick, whereby said wick is ignited without the lit fuse being snuffed out as it progresses from one wick to the other through said apertures formed therein so as to allow each wick to be selectively positioned along said fuse line.

2. The combination as recited in claim 1, wherein oppositely disposed free ends of said fuse line include stop means formed thereon, whereby said candles are prevented from sliding off of said fuse line.

3. The combination as recited in claim 2, wherein said apertures have a diameter greater than the diameter of the fuse line.

4. The combination as recited in claim 3, wherein said diameter of said aperture is two to five times greater than the diameter of said fuse line, whereby an ignited fuse line will burn through said aperture to ignite each wick portion without interruption.

5. The combination as recited in claim 4, wherein said fuse line includes equally spaced markings along the length thereof, whereby said candles may be selectively spaced and positioned apart from each other.

6. The combination as recited in claim 4, wherein said fuse line comprises one of the following combustible materials consisting of 100% cotton, synthetic-cotton blend, nylon, polyester, rayon or any suitable combination thereof.

7. The combination as recited in claim 4, wherein said stop means comprises a wax bead.

8. The combination as recited in claim 4, wherein said stop means comprises a knot formed at each end of said fuse line.

9. A combination as recited in claim 4, wherein said candles are birthday-size candles having an approximate length of between 55 mm and 60 mm and a diameter of approximately 5 mm.

10. A method of progressively igniting a multiplicity of candles mounted on an elongated fuse line, comprising the steps of:

providing a multiplicity of candles, each of said candles having a wax body member and an elongated wick positioned within said wax body member, wherein an upper portion of said wick extends outwardly and upwardly from said body;

forming said wick with a flat portion;

forming an aperture in said flat portion of said wick;

forming said apertures so as to have a diameter at least greater than the diameter of the fuse line to allow said fuse line to burn through each of said apertures to progressively ignite each wick at the flat portion without the flame affecting the wax body of each candle during the igniting of the wick and thereby igniting each wick sequentially without being snuffed out;

stringing said elongated fuse line through said aperture of each said wick in a manner whereby said candles are slidably mounted so as to be selectively positioned along said fuse line;

providing stop means adjacent free ends of said fuse line, whereby said candles are prevented from sliding off of said fuse line.

11. The method as recited in claim 10, wherein said diameter of said aperture is formed two to five times greater than the diameter of said fuse line, whereby when said fuse line is ignited the flame thereof will burn through said aperture to ignite each of said wick portions without interruption.

12. The method as recited in claim 11 including the steps of:

providing equally spaced markers along the length of said fuse line; and selectively arranging said candles on a cake to define a particular configuration or design.

* * * * *